United States Patent [19]

Riback et al.

[11] Patent Number: 4,626,175

[45] Date of Patent: Dec. 2, 1986

[54] FLOAT SWITCH CABLE CLAMP

[75] Inventors: Richard Riback, Highland Park; Francois Geneve, Chicago, both of Ill.

[73] Assignee: Expert Corporation, Chicago, Ill.

[21] Appl. No.: 768,454

[22] Filed: Aug. 22, 1985

[51] Int. Cl.[4] ..... F04B 49/04

[52] U.S. Cl. ..... 417/40; 411/422

[58] Field of Search ..... 417/40, 422, 423.1

[56] References Cited

U.S. PATENT DOCUMENTS

| | | | |
|---|---|---|---|
| 2,865,295 | 12/1958 | Laing | 417/234 |
| 3,082,940 | 3/1963 | Frantz | 417/423.1 |
| 3,246,186 | 4/1966 | Schaeffer | 417/422 |
| 3,327,144 | 6/1967 | Double | 417/40 |
| 3,457,866 | 7/1969 | Komor | 417/422 |

*Primary Examiner*—William L. Freeh

*Attorney, Agent, or Firm*—Laff, Whitesel, Conte & Saret

[57] ABSTRACT

A novel fluid pump housing for a fluid pump with a float switch is disclosed. The housing includes a clamp adapted to removably hold the float cable in a predetermined position and to allow manual release and reinsertion of the float cable at different positions along the length of the cable without the use of tools.

17 Claims, 6 Drawing Figures

FLOAT SWITCH CABLE CLAMP

BACKGROUND OF THE INVENTION

1. Field of the Invention

The present invention relates to fluid pumping equipment. More particularly, the present invention relates to a housing for a fluid pump which incorporates a novel pump float cable clamping device. The cable clamping device is capable of manually receiving or releasing the cable without the use hand or power tools.

2. Background of the Invention

A wide variety of fluid pumps and fluid pump housings have long been known in the art. One particular style of fluid pump which is generally intended to be permanently or semi-permanently mounted within a shallow pit or sump, has become commonly known as a sump pump.

Sump pumps are utilized for many applications, which may be of long or short term duration. These applications include contingent-type emergency service as well as normal intermittent or continuous operation. Although many prior sump pumps have been designed which are intended to be controlled manually, it has generally been found more effective to provide a switching device which automatically turns the sump pump on and off as required. The automatic switching device is commonly provided integral with or as an appendage to the sump pump.

Several types of automatic power switches have been provided with sump pumps. Particularly successful prior art pump switches include ball floats which are connected to a rod mechanism pivotally attached to the pump housing. The mechanism is such that the rod pivot shaft switches the pump on when the ball float has reached a predetermined level.

A second pump switch has been provided by a floatable motor shell or housing. The motor housing rises and falls with the liquid level and thereby activates a switch which operates the pump. Another type of sump pump switch is provided by an automatic pressure switch. These pressure switches are generally located in cavities. The cavities fill with fluid, and the fluid applies pressure to the switch to energize the pump.

Another type of sump pump switch is provided by an adjustable float tethered to the sump pump housing. A float is used which is similar in appearance to a conventional ball float. However, the switching mechanism is generally contained within the float housing. Instead of a rigid ball float rod, the switch float is connected to the sump pump by a flexible multistrand cable or tether. Conductor elements extend through the cable from the switch inside the float to pump motor. Unlike rigid ball float rod operated sump pumps, where the changing attitude of the connecting rod operates the switch, the float switch sump pump is turned on and off by the specific attitude of orientation of the switch float housing. The switch float attitude of orientation is dependent upon cable length and fluid depth, whereby the force applied to one end of the float housing by the taut cable as the float reaches the upper and lower limits of its intended travel causes the float to tilt and activate the switch inside as the float attitude changes.

Therefore, it is seen that the level of water required to acheive a switch float attitude orientation sufficient to turn the switch float on and energize the sump pump is determined by the length of the multistrand cable or tether which extends between the switch float to the sump pump. Accordingly, sump pumps can be provided with switch floats which adjustably respond to, and thereby control, different water levels by lengthening or shortening the multistrand cable. Use of a cable clamp allows the effective length of the cable to be varied by changing the point at which the cable is attached to the housing.

A variety of multistrand cable clamps have been previously used. Generally, a fixed length of multistrand cable is provided and the cable is releasably tethered to the sump pump at any desired location along the cable. The cable is tethered by the cable clamp, which is itself fixed to the sump pump. The cable tethering or clamping structures previously used include a "hairpin" type structure. The hairpin provides two generally parallel elongated members which are joined together at one end by a loop, and a tightening device to tighten the two elongated members together around the cable. Generally a bolt and nut assembly is used as a tightening device. The multistrand cable is passed through the hairpin loop connecting the elongated members. The hairpin/bolt assembly is then tightened with tools such as a screwdriver and pliers until the hairpin loop is closed around the cable, securing it in place.

Another method of adjustably securing the multistrand cable to the sump pump housing uses a device known as a "pigtail". A pigtail is constructed from a flexible piece of spring steel or alloy which has been bent into a widely spaced helix. One end of the coiled helix includes a straight piece of spring steel which extends radially from the helix and is attached to the pump housing. The internal diameter of the helix coil is slightly less then the external diameter of the multistrand cable, while the axial spacing between the helical coils is slightly greater than the external diameter of the multistrand cable. Therefore, the multistrand cable is attached to the sump pump housing by the pigtail device at any desired location by tangentally feeding the cable into the spaces between the helical coils serially from one end of the pigtail to the other.

These prior art cable retention devices have inherent design flaws which preclude, to some extent, their usefulness for their intended function. Hairpin type devices generally require hand or power tools to loosen the bolt and nut assembly which secures the hairpin loop around the multistrand cable. The use of such hand or power tools is particularly cumbersome where the sump pump is totally submerged in the liquid medium which level the pump is controlling. Hairpin type devices also tend to permanently deform the cable housing. Although removing a cable from the pigtail does not require tools, it is obvious that "unfeeding" the cable from the helical loops is a laborious act which requires significant time, particularly as to submerged sump pumps. This is also true of removing the cable from the hairpin loop.

SUMMARY OF THE INVENTION

It is an object of the present invention to provide a sump pump housing with a manually operable float switch cable clamp device.

It is another object of the present invention to provide a sump pump housing with an integral cable clamping device.

It is another object of the present invention to provide a sump pump housing which features a cable clamping device wherein the length of the cable extending between the housing and a remote float switch, and thereby the upper and lower limits of the level of the fluid to be controlled, can be adjusted manually without the use of tools.

In a broad embodiment therefore these objects and others are provided by an improved sump pump housing including a manually releasable multistrand cable clamping device.

While the housing which provides the cable clamping device is referred to as a sump pump housing in the preferred embodiment, it will be understood that the invention is applicable to many types of structures or housings which are adapted to releasably secure a cable for the purpose of altering the effective length of the cable, and the terms "sump pump" or "housing" are intended to include any such devices.

BRIEF DESCRIPTION OF THE DRAWINGS

In the drawings, which constitute a part of this specification, the preferred embodiment demonstrating the various objectives and features of the invention is set forth wherein.

DETAILED DESCRIPTION OF THE INVENTION

Figure 1:
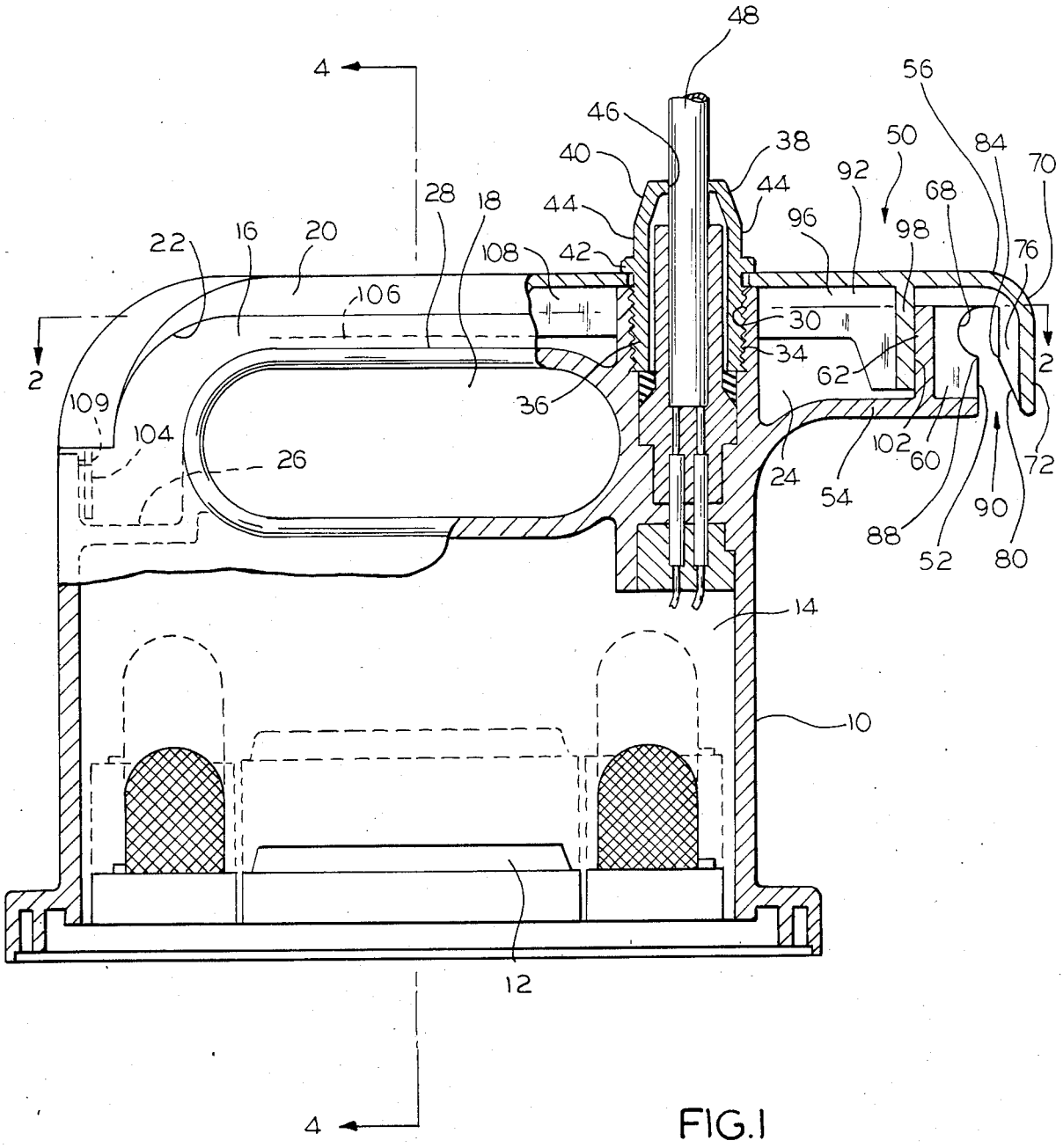
FIG. 1 is partially cut-away side elevation view of a typical sump pump upper housing incorporating the present invention.

Referring to FIGS. 1–4 and 6, a sump pump housing piecework, generally designated 10, is shown. Housing 10 may be constructed of any suitable rigid material, including but not limited to metals and metallic alloys, thermosetting plastics, thermoplastics, and the like. The sump pump mechanism 12, which includes the electric motor drive 13 associated therewith (FIG. 6), is shown partially illustrated in FIG. 1 within housing interior 14. The upper area of the housing 10 includes a handle 16 which defines an aperture 18. Aperture 18 is of sufficient size to be easily manually grasped. Handle 16 is completed by the addition of separate handle cover 20 which is removably attached to housing 10.

Figure 2:
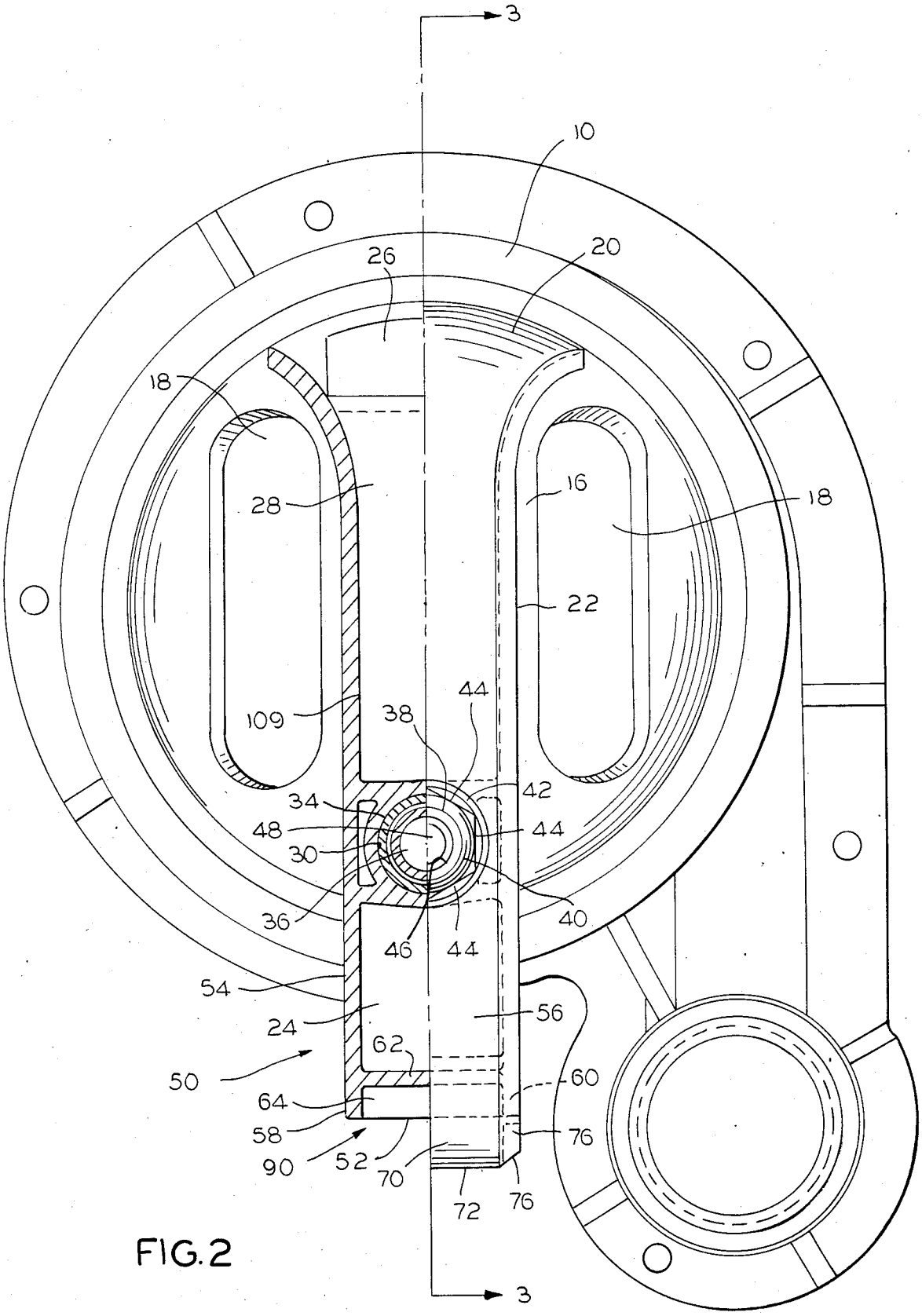
FIG. 2 is a partially cut-away top plan view of the present invention taken generally along the line 2—2 of FIG. 1.
Figure 3:
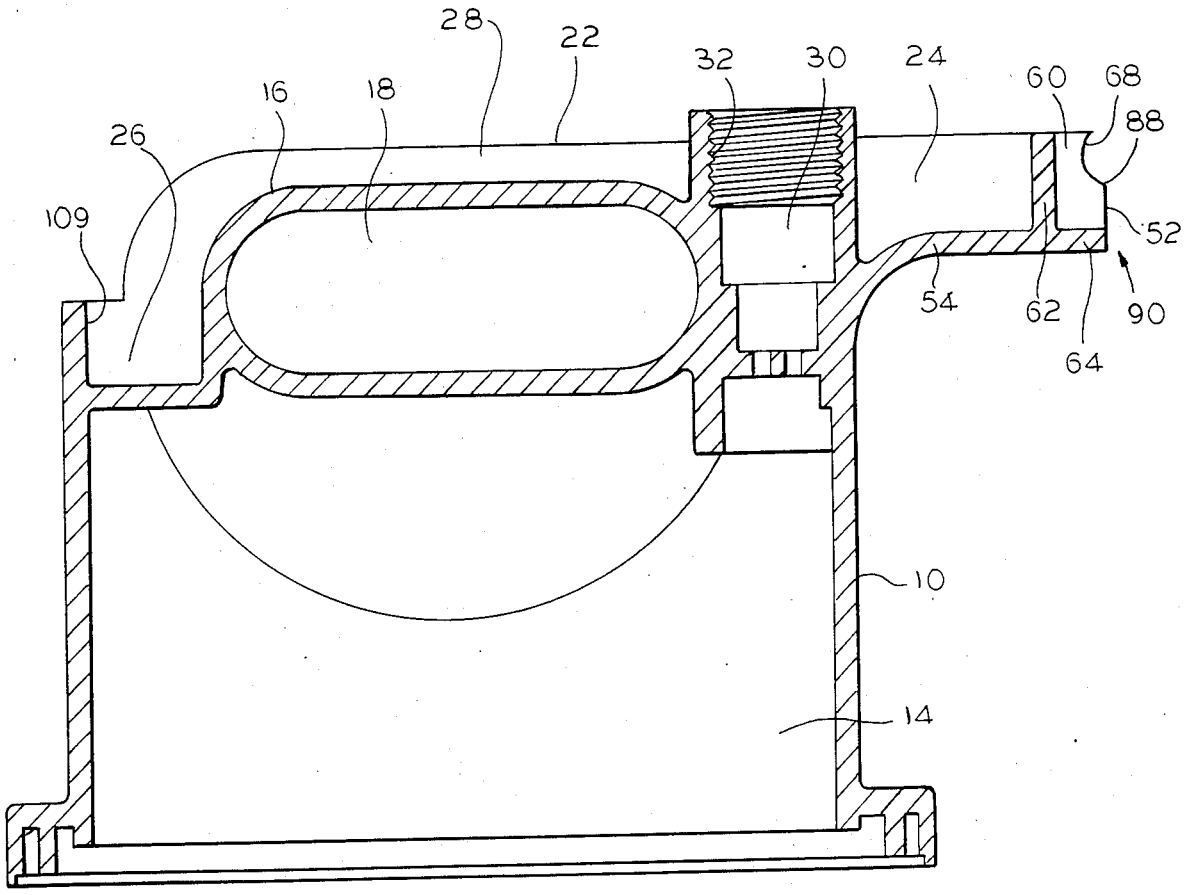
FIG. 3 is a cut-away side elevation view of the present invention taken generally along the line 3—3 of FIG. 2.

The top surface 22 of housing 10 includes cutouts 24, 26 and open channel 28 best seen in FIGS. 2 and 3. Cutouts 24, 26 and channel 28 result from the optimum design of the mold for the housing 10, which is formed by an injection molding process. Aperture 30 is also provided in the top surface 22 of housing 10. The inside surface of aperture 30 is provided with threads 32 which are adapted to releasably engage similar mating threads 34 on the outside surface of the lower section 36 of retaining bolt 38. The upper section 40 of retaining bolt 38 is separated from the lower section 36 by retaining lip 42. Retaining bolt upper section 40 includes equal and parallel hexagonal surfaces 44. Surfaces 44, as seen in FIG. 2, are engagable by common hand tools to tighten or loosen retaining bolt 38. Retaining bolt 38 is also provided with an axially oriented aperture 46 which extends therethrough. Aperture 46 is designed to accomodate an electric power cable 48 which contains suitable wiring therein and which is required to energize motor assembly 12 and power the sump pump. Retaining lip 42 secures handle cover 20 against top surface 22 of housing 10 when retaining bolt 38 is tightened. Therefore, handle cover 20 may be removed by loosening retaining bolt 38.

Figure 5:
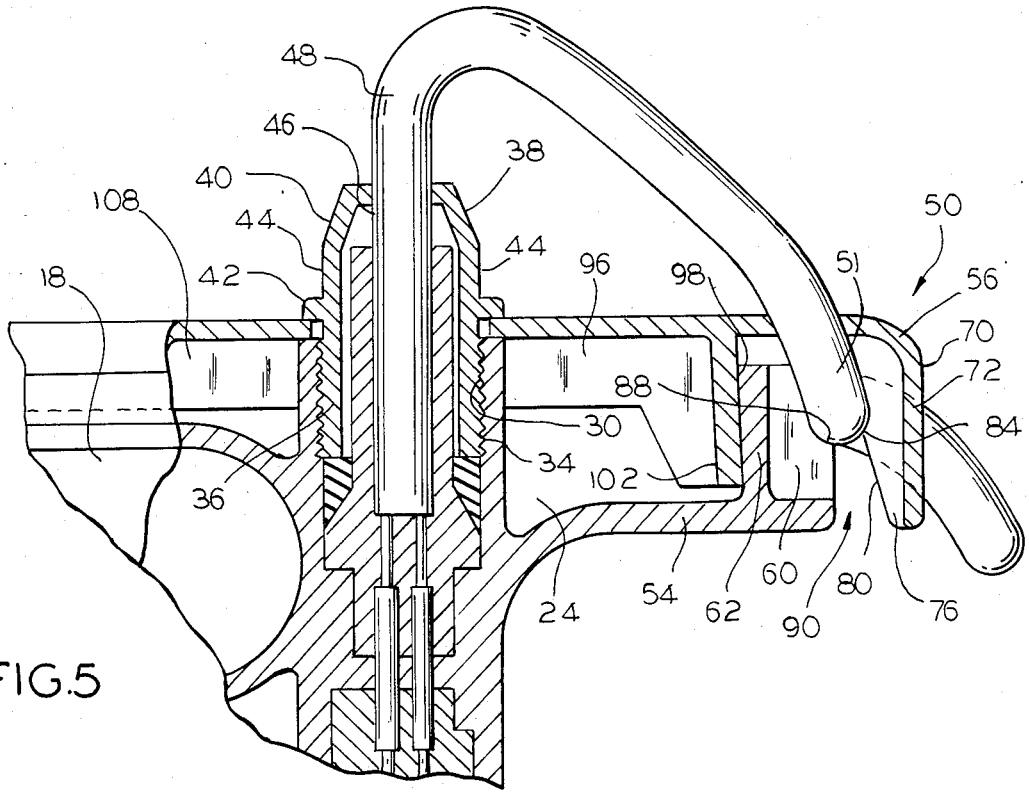
FIG. 5 is an enlarged sectional detail view illustrating the cable clamp portion of the housing of FIG. 1.
Figure 4:
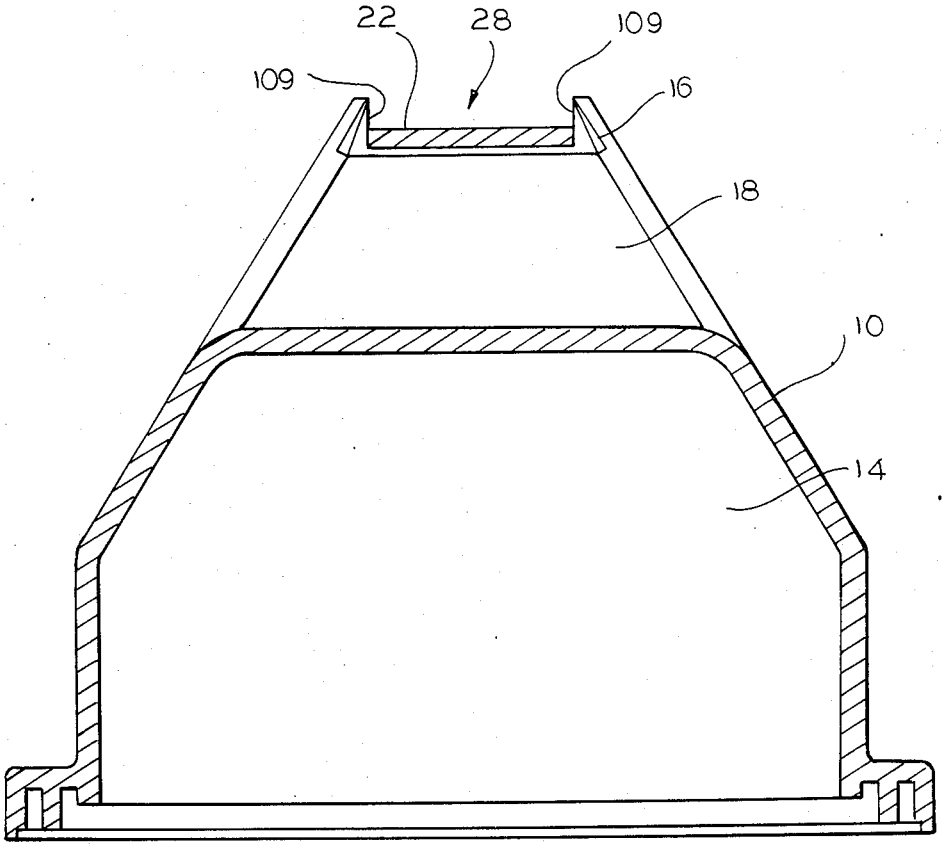
FIG. 4 is a cut-away side elevation view of the present invention taken generally along the line 4—4 of FIG. 1.
Figure 6:
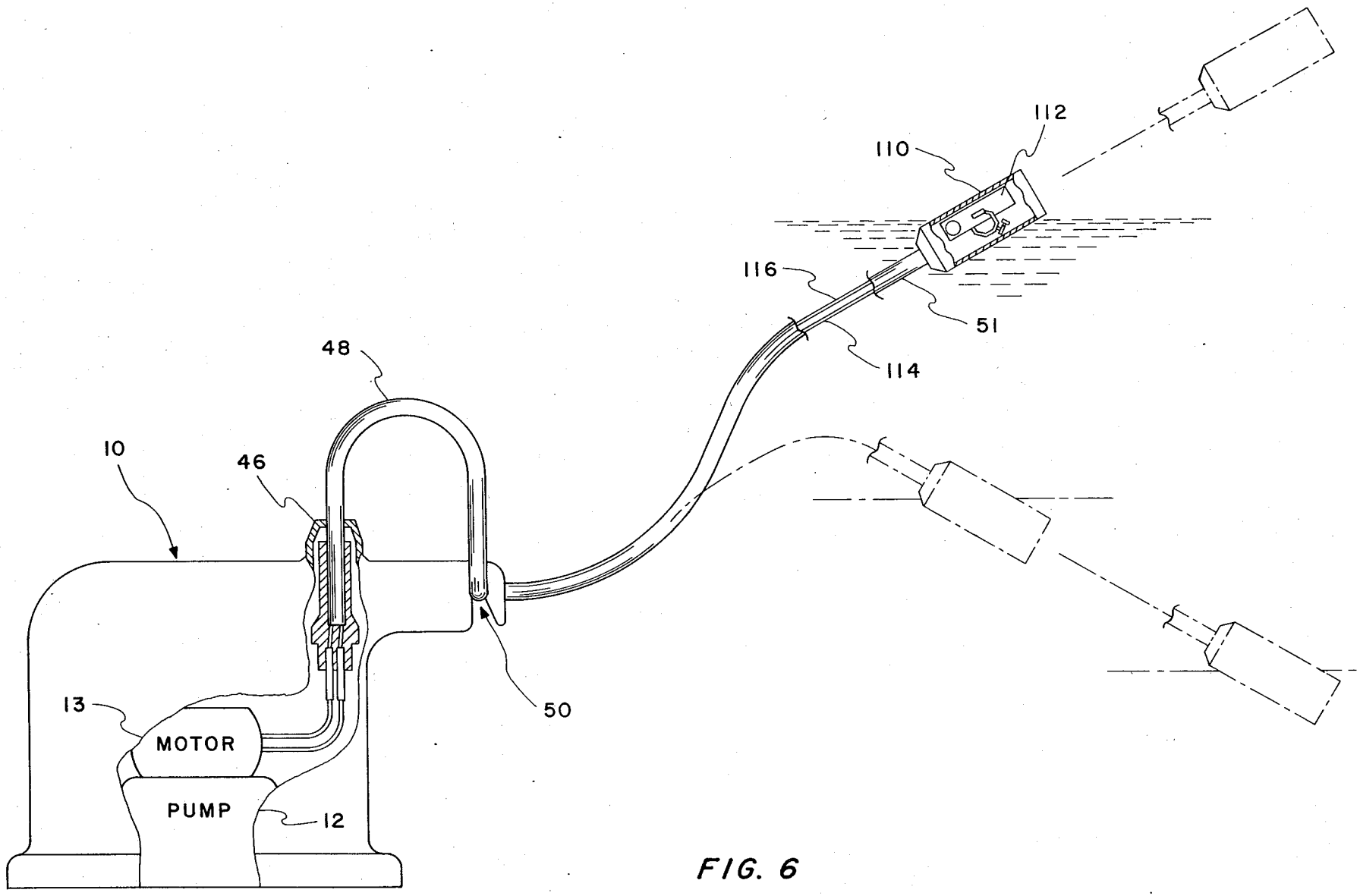
FIG. 6 is a schematic diagram of the sump pump, pump motor, float switch, and the wiring forming the conductive path between the float switch and the pump motor.

Handle cover 20 is provided to cosmetically complete housing 10 by covering cut outs 24, 26 and open channel 28. Cover 20, cooperating with a portion of housing 10, also provides a slightly flexible or deformable cable clamp, generally designated 50, for the float switch multistrand cable 51, both seen in FIG. 5. Cable clamp 50 includes the outer edge 52 formed by a flange of housing extension 54 as well as cover extension 56. As seen in FIG. 1, cut-out portion 24 is located within extension 54. The outer edge 52 of housing extension 54 includes two extending vertical walls 58, 60. Vertical walls 58, 60 are rigidly joined by vertical divider 62 and horizontal floor 64. In this manner, vertical walls 58, 60 (FIGS. 2, 3) are substantially inflexible during use. Each vertical wall 60, 62 also features a multistrand cable receiving aperture or capture portion 66, 68, respectively. Cable apertures 66, 68 are provided as arcuate cutouts which are vertically oriented within the upper half of their respective vertical walls 60, 62, as viewed in FIG. 1. In the preferred embodiment, the arc length of cable aperture 66, 68 is approximately $\frac{1}{3}$ of the circumference of the multistrand housing cable which cable clamp 50 is intended to restrain.

Cable clamp 50 also is formed by a portion of handle extension 56. As mentioned, handle cover extension 56 includes a vertical section 70 that functionally interacts with housing extension 54 to form cable clamp 50. Vertical section 70 includes vertical wall 72 which is oriented generally parallel to vertical wall 62. Vertical section 70 also includes vertical side walls 74, 76, which are each oriented perpendicular to vertical wall 72. Vertical walls 74, 76 may be of different thickness than vertical walls 58, 60. However, in the preferred embodiment it is desired that the edges of walls 58, 60 and 74, 76, respectively overlap to at least some extent so that wall 58 is substantially adjacent wall 74, and wall 60 is substantially adjacent wall 76. It has been discovered that the float cable housing will be less deformed when restrained when there is a greater amount of overlap.

Vertical side walls 74, 76 further include a beveled or tapered section to guide float cable 51 into cable clamp 50. The guide is formed by bevels 78, 80 formed in the lower half of vertical side walls 74, 76, respectively. The upper half of vertical side walls 74, 76 is not beveled and is oriented generally parallel to outer edge 52 formed by vertical walls 58, 60. The transformation in vertical side walls 74, 76 from beveled sections 78, 80 respectively to the unbeveled vertical sections is made at apex 82, 84, respectively. Apexes 82, 84 are approximately located adjacent the lower extremes of cable apertures 86, 88, respectively.

Cable clamp 50 operates as follows. After an operator determines a desirable location along the length of float cable 51 to secure the cable to housing 10, that section of cable 51 is placed at opening 90 (FIG. 1). The float cable 51 is pulled upwards against the biasing force imparted by bevels 78, 80 and the inherent rigidity of cover 20 until the cable 51 reaches apexes 82, 84. As float cable 51 approaches the top of bevel 78, 80 vertical section 70 flexes slightly and allows cable 51 to be inserted into apertures 66, 68. Immediately past the point defined by apexes 82, 84, float cable 51 is snapped into cable clamp 50 where it is retained within cable apertures 66, 68 by the flat vertical surfaces of vertical side walls 74, 76. Thus it is seen that cable clamp 50 provides an overcenter snapping action with respect to effort. The overcenter provides the snapping into place of cable 51 which positively tells the user that float cable 51 has been correctly restrained. This is particularly useful for permanent installations, where housing extension 54 may not be visible to the user who is adjusting float cable 51.

Once float cable 51 is in place, it is securely restrained by the overcenter force, which overcenter force is itself provided by apexes 82, 84 being substantially equal with the lower extremes 86, 88 of cable apertures 66, 68. The overcenter feature of cable clamp 50 is designed to allow the stress on insulated conductor cable 51 to build up slowly so as to not rip or abrade the insulation surrounding cable 51. The preferential overlap of the thicknesses of vertical walls 74, 76 and vertical walls 58, 60, respectively, effectively precludes any axial movement of float cable 51 once it is inserted into clamp 50.

Cable clamp 50 is designed to enable manual removal of cable 51 from the clamp, without the use of hand or power tools, and the manual re-insertion of the cable in the clamp at a different point along the length of the cable. To remove cable 51 from clamp 50, the user merely grasps the cable with the hands and exerts a force pulling cable 51 out of opening 90. Vertical section 70 is designed to flex outward as the cable is removed from the clamp, in quite the same manner as section 70 flexed outward when the cable was inserted into the clamp. The particular design of clamp 50 combined with the inherent tensile strengths of the materials forming each element of clamp 50 permit the insertion and removal of cable 51 into and out of clamp 50 with the use of manual force. No additional leverage, power means or tools are required.

Since handle cover extension 56 is only permitted to flex a small distance when float cable 51 is inserted into or removed from clamp 50, a flex stop element 92 is provided. Flex stop element 92 includes stop walls 94, 96 which are oriented along the length of handle cover 20 and stop tab or rib 98. Stop tab or rib 98 connects stop walls 94, 96 at their front edges 100, 102, respectively. Stop tab 98 abuts vertical divider 62 when handle cover 20 is assembled on housing 10 to assist in properly positioning cover 20 on housing 10. This moves the flex beam pivot point, or the lateral component of the bending moment of handle cover extension 56 from aperture 30 to vertical rib 98. Therefore, the flex beam length or bending moment of cover extension 56 is similarly decreased, which substantially stiffens and limits the flexing moment of handle cover extension 56 when cable 51 is inserted into clamp 50.

A rear tab 104 and side tabs 106, 108 are provided to engage the lips 109 of the housing top surface 22 which define cut-out 26 and open channel 28, respectively. These tabs 104, 106, 108 add additional rigidity to handle cover 20, and provide additional means to assist in properly positioning cover 20 relative to housing 10. More importantly, tabs 104, 106, 108 prestress stop tab 98 against vertical divider 62 to provide greater strength to the clamping action of clamp 50. The force provided by stop tab 98 against vertical wall 62 is increased when retaining bolt 38 is tightened and retaining lip 42 pushes handle cover 20 downwardly, securing handle cover 20 against the housing top surface 22.

Since certain changes may be made to the above-described teachings without departing from the scope of the invention, it is intended that all matter contained in the above description or shown in the accompanying drawings shall be interpreted as illustrative and not in a limiting sense.

We claim:

1. A fluid pump adapted to control the level of a fluid medium; including a housing encasing said fluid pump;

drive means in said housing for driving said fluid pump;

switch means associated with said drive means for turning said drive means and said fluid pump on and off;

said switch means housed in a float element adapted to float on the upper level of said fluid medium;

cable means extending between said float element and said drive means in said housing, said cable means exerting a force on said float element when the level of said fluid medium reaches a predetermined maximum level, whereby the attitude of said float element changes responsive to said force exerted by said cable means;

said switch means adapted to turn said drive means on and off responsive to the change in attitude of said float element;

the improvement comprising: clamp means associated with said housing;

said clamp means adapted to removably hold said cable means in a predetermined stationary position whereby the distance between said clamp means and said float element remains constant while said clamp means engages said cable means;

said clamp means adapted to provide manual release of said cable means from said clamp means and subsequent manual re-insertion of said cable means in said clamp means at a different position along the length of said cable means whereby the distance of said cable means extending between said clamp means and said float element is changed.

2. The fluid pump of claim 1 wherein said cable means comprises a flexible conduit having conductor elements therein, said conductor elements extending between said switch means and said drive means.

3. The fluid pump of claim 1 wherein said clamp means comprises a substantially U-shaped opening formed as part of said housing, said U-shaped opening having two spaced apart, opposing side wall means, the distance between said opposing side wall means at the base of said opening being less than the diameter of said cable, one of said side wall means having a tapered portion at the open end of said opening whereby the distance between said tapered portion of said one wall and the opposing wall changes from greater than the diameter of said cable at the open end of said opening to less than the diameter of said cable at the inward end of said tapered portion of said one side wall.

4. The fluid pump of claim 3 wherein said U-shaped opening includes a cut-away capture portion at the inward end of one of said side wall means.

5. The fluid pump of claim 4 wherein said cut-away capture portion and said tapered portion are on different side walls.

6. The fluid pump of claim 4 wherein said inward end of said tapered portion of said one side wall means joins a substantially vertical portion of said one side wall means.

7. The fluid pump of claim 6 wherein said substantially vertical portion of said one side wall means is disposed opposite said cut-away capture portion, said cut-away capture portion being located on said other side wall means.

8. The fluid pump of claim 4 wherein each said side wall means provides a wall support, said wall support including a pair of members disposed at opposite ends thereof, said members being disposed perpendicular to said wall support; said side wall support being oriented generally parallel to each other and each member on each support wall being oriented substantially coplanar with a member on the other support wall.

9. The fluid pump of claim 8 wherein said cut-away capture portion is located in each of the members of one wall support.

10. The fluid pump of claim 8 wherein said tapered capture portion is located in each of the members of one wall support.

11. A fluid pump having a housing, drive means enclosed in said housing for driving said pump, switch means disposed external of said housing and operatively connected to said drive means for actuating and deactivating said drive means, conductor bearing cable means forming said operative connection between said switch means and said drive means, the improvement comprising:

handle means forming part of said housing, the upper portion of said handle means including channel means;

a separate cover means removably extending over said channel means and removably attached to said housing;

said housing including a flanged portion extending therefrom;

said cover means including an extendable portion thereof which extends in spaced relation adjacent said flanged portion of said housing forming an opening between said extendable portion of said cover means and said flanged portion of said housing;

said opening providing means to removably clamp said cable means to said housing.

12. The fluid pump of claim 11 wherein said flanged portion of said housing forms a rigid first wall of said opening and said extendable portion of said cover means forms a flexible, opposing second wall of said opening;

said cover means including a laterally disposed rib member attached thereto at a predetermined distance from said second wall of said opening, said rib member defining the lateral component of the bending moment of said extendable portion of said cover means as the distance between said second wall of said opening and said rib member.

13. The fluid pump of claim 12 wherein one of said first and second walls of said opening includes a tapered portion wherein the distance between said first and second walls of said opening decreases from a size greater than the diameter of said cable means to a size less than the diameter of said cable means, whereby the cable means enters said opening with relative ease and is captured and releasably held between said first and second walls as said cable means is inserted further into said opening.

14. The fluid pump of claim 13 wherein one of said first and second walls includes a cut-out portion to capture said cable means when said cable is fully inserted in said opening.

15. The fluid pump of claim 12 including:

cut-out portions in said housing adjacent said channel, said rib means extending into one of said cut-out portions when said cover means is disposed over said channel means.

16. The fluid pump of claim 15 including:

tab means disposed on said cover means in spaced relation to said rib means, said tab means extending into another of said cut-out portions of said housing; said tab means and said rib means laterally locating and holding said cover means relative to said housing such that the distance between said first wall of said opening and said second wall of said opening is maintained at a predetermined constant dimension whereby a compression force is applied to said cable means by the tensile strength of said cover means to hold said cable means in said clamp.

17. The fluid pump of claim 16 including removable fastening means disposed between said cover means and said housing to removably attach said cover means to said housing.

* * * * *